United States Patent [19]

Grunert et al.

[11] Patent Number: 4,691,180

[45] Date of Patent: Sep. 1, 1987

[54] CIRCUIT BREAKER WITH ELECTRICAL DISCONNECT MEANS

[75] Inventors: Kurt A. Grunert, Beaver; Joseph F. Changle, Carnegie, both of Pa.

[73] Assignee: Westinghouse Electric Corp., Pittsburgh, Pa.

[21] Appl. No.: 875,914

[22] Filed: Jun. 19, 1986

[51] Int. Cl.[4] ..... H01H 75/00; H01H 77/00; H01H 83/00

[52] U.S. Cl. ..... 335/6; 335/13; 335/172

[58] Field of Search ..... 335/6, 16, 14, 20, 9, 335/13, 172, 201; 200/42 R, 42 T

[56] References Cited

U.S. PATENT DOCUMENTS

| | | | |
|---|---|---|---|
| 2,863,959 | 12/1958 | Lampe . | |
| 3,487,177 | 12/1969 | Shea . | |
| 3,582,592 | 6/1971 | Schadow . | |
| 3,602,673 | 8/1921 | Morin . | |
| 3,949,179 | 4/1976 | Bauer . | |
| 4,180,716 | 12/1979 | Suzuki . | |
| 4,280,026 | 7/1981 | Alessio . | |
| 4,532,486 | 7/1985 | Terrier | 335/14 |
| 4,553,115 | 11/1985 | Grunert | 335/14 |
| 4,554,421 | 11/1985 | Grunert . | |

*Primary Examiner*—E. A. Goldberg
*Assistant Examiner*—Lincoln Donovan
*Attorney, Agent, or Firm*—L. P. Johns

[57] ABSTRACT

A circuit breaker with electrical disconnect means characterized by a solenoid operator for moving a handle of a circuit breaker between ON and OFF positions. The solenoid operator includes a movable electromagnet and a movable armature for actuating the handle, an interlock switch serially connected to the electromagnet and a manual operator for overriding the solenoid operator by opening a circuit through the interlock switch.

13 Claims, 10 Drawing Figures

FIG. 2.
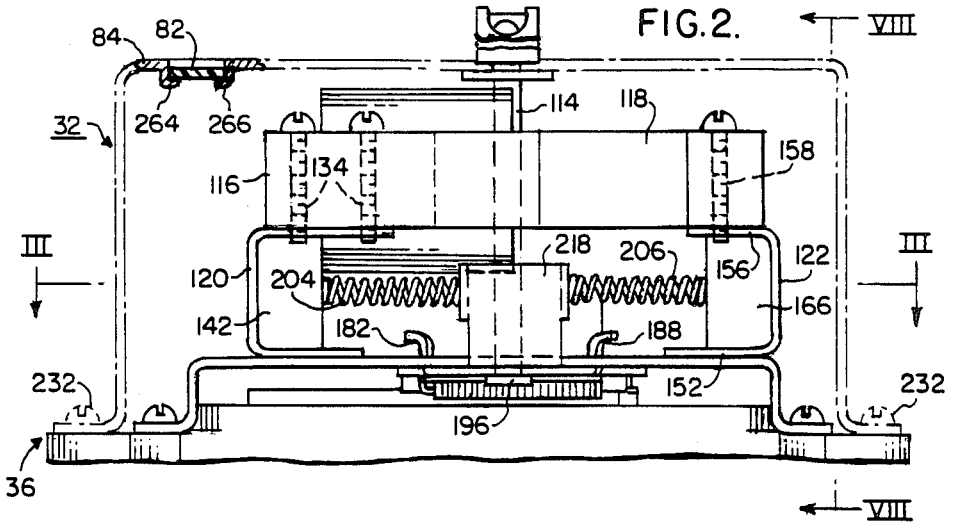
FIG. 3.
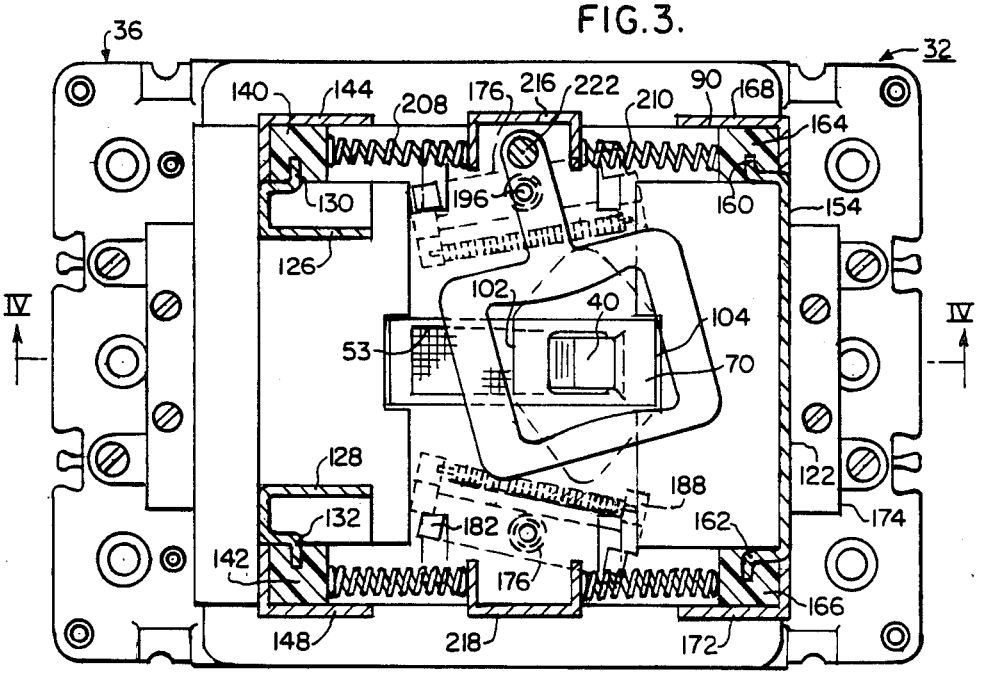
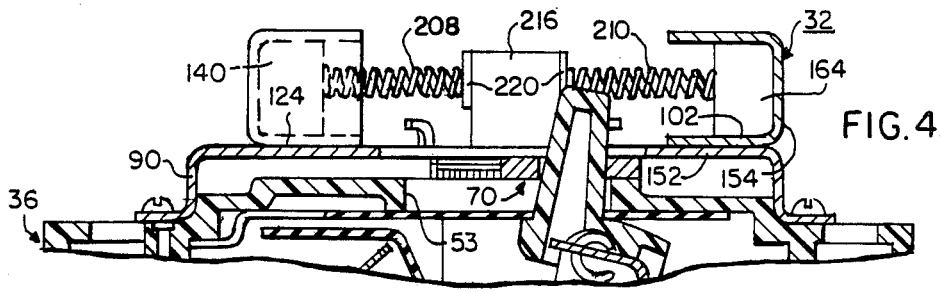
FIG. 4.

FIG. 5.
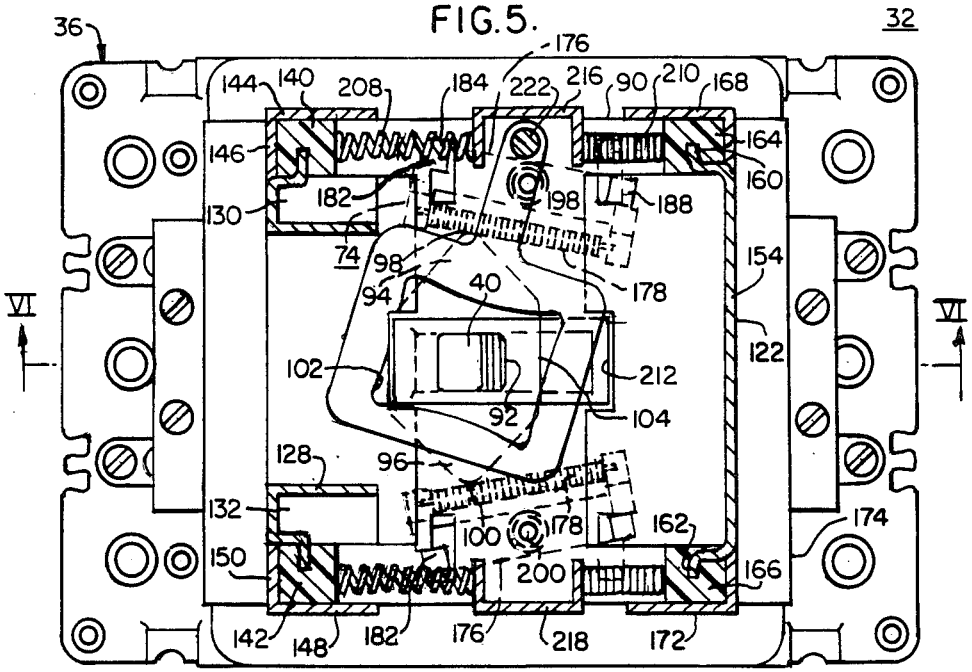
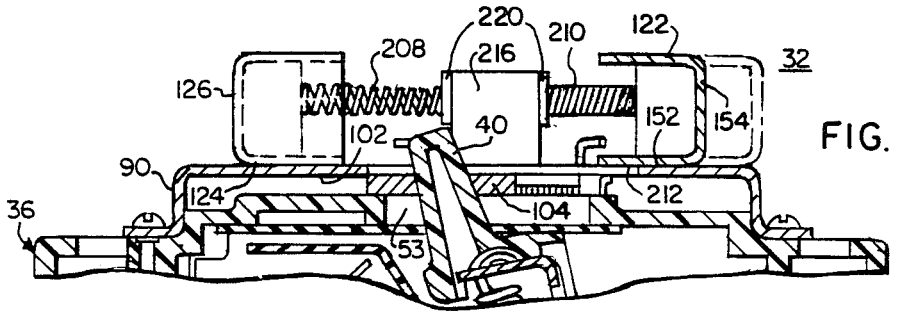
FIG. 6.
FIG. 7.
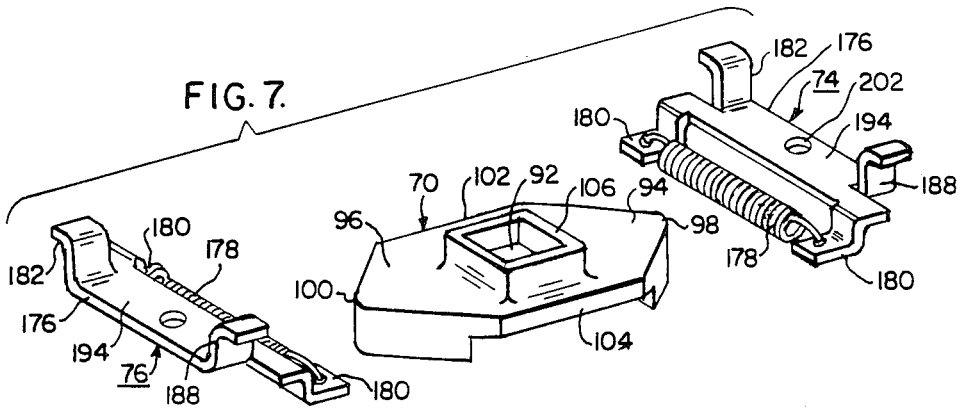

CIRCUIT BREAKER WITH ELECTRICAL DISCONNECT MEANS

CROSS REFERENCE TO RELATED APPLICATION

This invention relates to molded case circuit breakers, such as that disclosed in Ser. No. 569,054, filed Jan. 9, 1984, by K. A. Grunert and W. K. Huffman and entitled "Molded Case Circuit Breaker With Single Solenoid Operator For Rectilinear Handle Movement" (W.E. Case 51,655).

BACKGROUND OF THE INVENTION

1. Field of the Invention

This invention relates to molded case circuit breakers and, more particularly, it pertains to a remotely controlled solenoid operator for changing the operational condition of the circuit breaker and including a manual operator for overriding the operators.

2. Description of the Prior Art

Molded case circuit breakers of prior art construction comprise movable contact structures and operating mechanisms for providing protection for electrical circuits or systems against electrical faults, including electrical overload conditions, low-level short circuit or fault circuit conditions, and, in some cases, high-level short circuit or fault current conditions. Those devices have employed an operating structure including a trip mechanism for controlling movement of an over-center toggle device for separating a pair of electrical contacts in response to an overload condition or upon a short circuit or fault circuit condition. Some prior art devices also utilize an electromechanical or solenoid actuated operator for moving an otherwise manual handle from a remote location between its ON and OFF positions. Such devices have provided adequate protection against fault conditions in an electrical circuit, however, there is a need for a continued use of manual handle for the circuit breaker to override the remotely controlled operating mechanisms in the event of an emergency and/or maintenance situation.

Notwithstanding such prior art devices for providing adequate protection against fault conditions in an electrical circuit, a need exists for providing manual operation in emergency conditions to override the remote electrical operator.

SUMMARY OF THE INVENTION

In accordance with this invention, an electrical circuit breaker is provided which comprises a pair of separable electrical contacts; operating means for moving the contacts between open and closed positions and including a handle; a bracket engaging the handle for movement between said positions; solenoid actuated means for moving the bracket between OFF and ON positions corresponding to the CLOSED and OPEN positions of the contacts, the solenoid actuated means including an electromagnet and an armature separately movable against the bracket for alternately moving the operating means into one of the ON and OFF positions upon successive actuations of the solenoid actuated means; a bistable mechanical latch having first and second positions for alternately placing the bracket in the ON or OFF position upon successive actuations of the electromagnet; a manual operator for moving the bracket between the ON and OFF positions; the bracket being immovable by the electromagnet from the OPEN contact position when the manual operator is in the OFF position; the bracket being movable by the electromagnet between ON and OFF positions when the manual operator is in the ON position; the latch including stop means movable into and out of the path of movement of the bracket for preventing movement of the solenoid actuated means when the manual operator is in the OFF position; an interlock switch serially connected to the electromagnet for opening and closing the circuit to the electromagnet; a cover disposed over the assembly of the solenoid actuated means and the interlock switch; a switch button for the interlock switch mounted on the cover and being manually movable to open and close the switch; the interlock being in open circuit conditions when the cover is removed; a first movable plate fixedly mounted on the electromagnet and a second movable plate fixedly mounted on the armature, which plates are separately movable for guiding movement of the electromagnet and armature; mechanical latch movable between first and second positions for limiting movement of the first plate in the first position and for limiting movement of the second plate in the second position, the manual operator including an arm movable between the ON and OFF positions of the manual operator; the arm including a portion extending through an opening in the cover; the arm and cover having separable interfitting means for locking the arm in the ON or OFF position; the switch button including spaced notches corresponding to OPEN and CLOSED positions of the interlock switch; and the arm having an arm position disposed in one of the notches when the arm is in the OFF position.

BRIEF DESCRIPTION OF THE DRAWINGS

FIG. 2 is a side elevational view of a solenoid operator for the device of FIG. 1;

FIG. 3 is a plan view of the device taken along the line III—III of FIG. 2, depicting the handle of the circuit breaker in the OFF position;

FIG. 4 is a vertical sectional view of the device shown in FIG. 2 taken along the line IV—IV of FIG. 3;

FIG. 5 is a sectional view similar to that of view 3, depicting a handle of the circuit breaker in the ON position;

FIG. 6 is a vertical sectional view of the device of FIG. 2 taken along the line VI—VI of FIG. 5;

FIG. 7 is an exploded perspective view of the trigger bracket and spring latches of the device of FIG. 2;

DESCRIPTION OF THE PREFERRED EMBODIMENT

Figure 1:
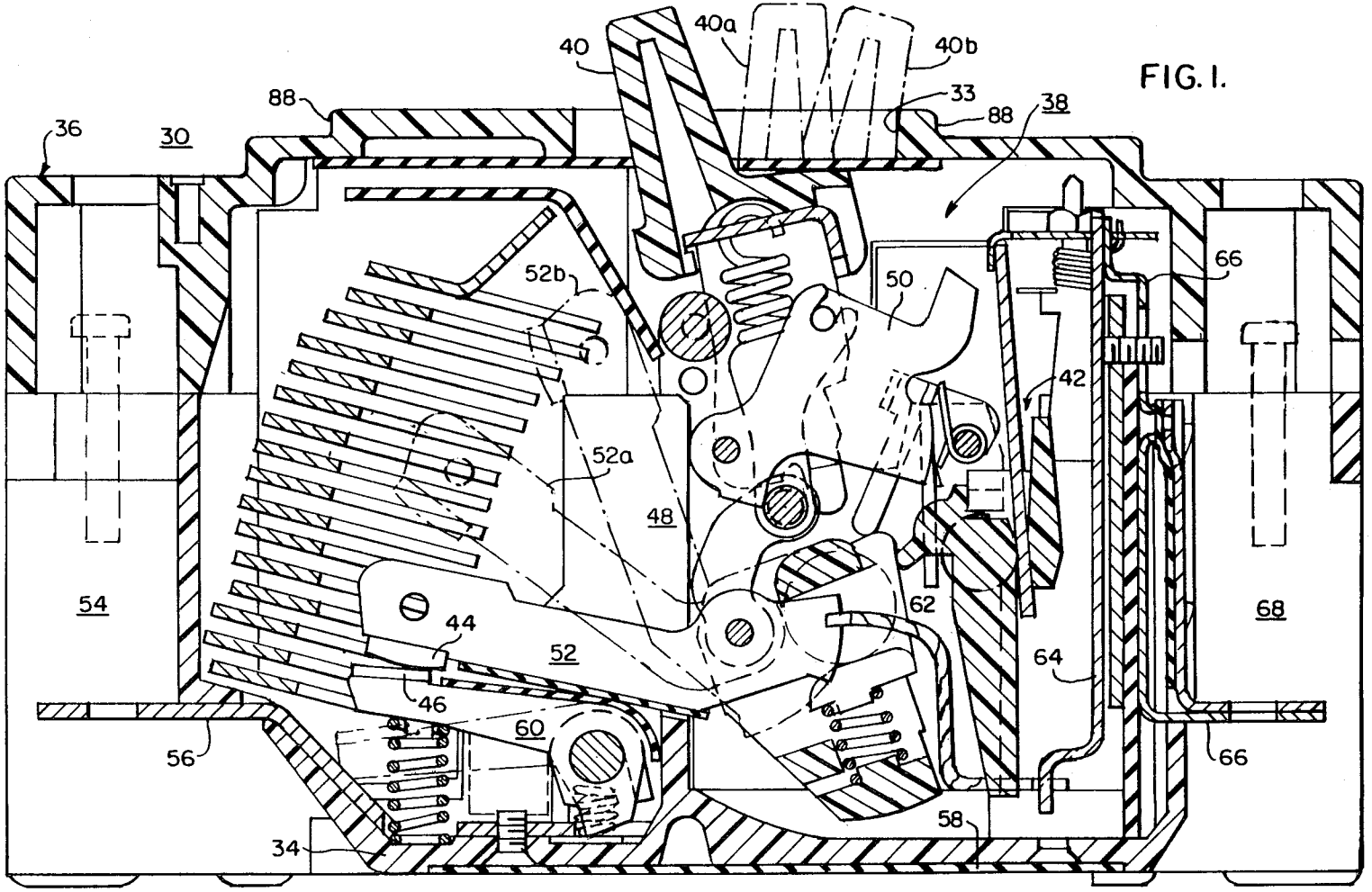
FIG. 1 is a vertical sectional view through the center pole or phase of a multi-pole circuit breaker.

In FIG. 1 a molded case circuit breaker is generally indicated at 30. Though the circuit breaker may be a three-phase or three-pole structure, the principles of the present invention disclosed herein are equally applicable to single-phase or other polyphase circuit breakers and to both AC and DC circuit breakers. The present invention concerns a handle locking mechanism 32

(FIGS. 2–10) in combination with the circuit breaker 30. A detailed description of the circuit breaker is set forth in U.S. Pat. No. 4,553,115, which is incorporated herein by reference.

The circuit breaker 30 comprises a housing which includes a base 34 and a cover 36. An operating mechanism 38 functions either in response to the movement of a handle 40, which is part of the mechanism 38, or in response to a trip unit 42 to move a movable contact 44 into and out of CLOSED and OPEN positions with respect to a lower contact 46. In addition to the handle 40 the operating mechanism 38 includes an over-center toggle mechanism 48 together with a releasable lever 50 that is detachably connected to the trip unit 42, whereby upon release by the unit the contacts 44, 46 separate with a contact arm 52 moving to a contact OPEN position indicated by the broken line position 52*a* and with the handle 40 moving to the position 40*a*.

More particularly, the handle is an electrically insulating, rigid, manually engageable member extending through an opening 53 in the cover 36 for setting the circuit breaker 30 to its CLOSED position (FIGS. 1, 5, 6), or to its OPEN position 40*b* (FIGS. 1, 2, 3, 4). The circuit breaker 30 may also assume a BLOWN-OPEN position 52*b*. When the contacts are closed a circuit through the circuit breaker extends from a line terminal 54 through a conductor 56, a spring 58, contact arm 60, contacts 46, 44, contact arm 52, a shunt 62, a bimetal 64, a conductor 66 to a load terminal 68.

The handle locking mechanism 32 (FIGS. 2–7) includes a bracket 70, solenoid actuated means for electromagnet 72, bistable spring latches 74, 76, a manual operator 78, an interlock switch 80, a switch button 82 and a cover 84 for housing the assembly of the several parts 70–82.

The bracket 70 (FIG. 7) is a formed object comprised of an electrically insulating material having a channel 86 configured to receive an elongated, upwardly projecting, pedestal portion 88 on the top of the cover 36 and disposed for rectilinear movement along the longitudinal axis of the opening 53. The bracket 70 is captured between a mounting plate 90 and the pedestal portion 88 to limit movement of the bracket to rectilinear movement along the longitudinal axis of the opening 53. The bracket 70 also includes a centrally disposed aperture 92 through which the handle 40 extends, whereby the bracket and handle move in unison. The bracket 70 also includes a pair of integrally formed, outwardly extending, tapered latch engaging end portions 94, 96. These portions are formed by a pair of similar converging sides that form rounded vertical edges 98, 100 having a relatively small radius of curvature. The bracket also comprises a pair of drive surfaces 102, 104. The bracket 70 also includes an integral upwardly extending projection 106. An operating handle 108 which is part of the manual operator 78 (FIG. 10), includes an opening 110 in which the projection 106 is captured, whereby movement of the operating handle 108 moves the bracket 70 and the handle 40 between open and closed positions of the contacts 44, 46.

The electromagnet 72 (FIG. 2) includes an electrical coil 114 mounted on a magnet core 116. The electromagnet 72 also includes a generally T-shaped armature 118 that is movable with respect to and within the coil 116. The electromagnet 72 is mounted on a drive bracket 120 that is disposed for rectilinear movement on the mounting plate 90 and along the longitudinal axis of the opening 53. Likewise, the armature 118 is mounted on a drive bracket 122 that is also disposed for rectilinear movement on the mounting plate 90 along the longitudinal axis of the opening 53.

The drive bracket 120 is a U-shaped member having a drive plate 124 that is slidably mounted on the mounting plate 90. The drive bracket 120 also includes spaced upright flanges 126, 128 having out-turned flanges 130, 132 on which the core 116 is fixedly mounted such as by screws 134. The upright flanges 126, 128 include out-turned ears 136, 138, respectively, the outer ends of which are provided with guide blocks 140, 142, respectively. The guide block 140 is contained within guide plates 144, 146 and the guide block 142 is contained within guide plates 148, 150. The guide plates 142, 150 extend upwardly and are an integral part of opposite sides of the mounting plate 90.

The drive bracket 122 on which the armature 118 is mounted is a U-shaped member having a drive plate 152, a bight or upright portion 154, and an in-turned portion 156 on which the armature is mounted by suitable means such as screws 158. The upright portion 154 includes a pair of out-turned ears 160, 162 supported on guide blocks 164, 166, respectively. The guide block 164 is contained between guide plates 168, 170 and the guide block 166 is contained within guide plates 172, 174, which plates extend upwardly from the mounting plate 90.

The latches 74, 76 (FIG. 7) are pivotable, bistable mechanical spring latches operative to alternately engage and stop movement of the drive plates 124, 152. Each of the latches 74, 76 includes a formed latch plate 176 and an elongated tension spring 178. Opposite ends of each tension spring 178 are secured to integrally formed, spaced-apart spring mounting members 180.

The latch plates 176 include integrally formed, upwardly extending electromagnet drive plate stops 182 that extend through and above latch slots 184, 186 formed in the mounting plate 90 and that function to engage in stop movement of the electromagnet drive plate and stop movement of the electromagnetic drive plate 120 (broken line portion of FIG. 3). The latch plates 176 also include integrally formed, upright extending armature drive plate stops 188 that extend through latch slots 190, 192 formed in the mounting plate 90 and that function to engage and stop the movement of the armature drive bracket 122 (solid line portion of FIG. 5).

The stops 182, 188 are formed at opposite ends of an elongated planar surface 194 of the latch plate 176 that is disposed for pivotal movement beneath the mounting plate 90. The latches 74, 76 are secured for pivotal movement to the mounting plate 90 by pivot rivets 196 disposed in the latch pivot apertures 198, 200 and in an aperture 202 formed through each planar surface 194 of the latches 74, 76. The bistable latches 74, 76 are capable of being rapidly pivoted between two stable states or positions, an electromagnetic drive plate stop state or position (FIGS. 2–4), and an armature drive plate stop state or position (FIGS. 5 and 6), from one side to the other side of the pivot centers of the spring latches 74, 76 located at the centers of the pivot rivets 196.

Prior to energization of the solenoid 72 to initiate a switching operating of the circuit breaker 30, the drive plates 120, 122 are biased by compression springs 204, 206, 208, 210 to their outermost limit positions. If the handle 40 is in its OFF position corresponding to the OPEN position of the separable electrical contacts 44, 46 (FIGS. 2–4), a drive surface 212 of the armature drive plate 152 is in engagement with the projection 106 of the bracket 70. Upon actuation of the solenoid coil 114 by an electrical pulse from a remote location, the electromagnetic drive plate 124 is rapidly moved into engagement with the electromagnetic drive plate stops 182 of the latches 74, 76 (dotted line portion of FIG. 3); and the armature drive plate 152 is moved by the armature 118 as it moves into the coil 114. Thus the bracket 70 moves along the pedestal portion 88 together with the handle 40.

The armature drive plate 152 continues to move the bracket 70 and the handle 40 along the longitudinal axis of the opening 53 until a point is reached at which the toggle mechanism 48 accelerates the handle and the bracket 70 along the opening 53 to the ON position of the handle (FIGS. 5 and 6). As the rounded edges 98, 100 pass the pivot centers of the latches 74, 76, the latches pivot about their rivets 196 into their armature drive plate stop state or position, in which state the plate stops 182 are shifted to the outermost portion of the latch slots 184, 186 out of engagement with the electromagnet drive plate 120 and the armature drive plates' stops 188 are shifted to the innermost portions of the latch slots 190, 192 to stop or limit the movement of the armature drive plate 152 (solid line portion of FIG. 5). Subsequently, the armature drive plate 152 is returned to its normal, outermost limit position by the compression springs 206 and 210; and the drive plate 120 is retained in its outermost limit position by engagement of the drive surface 102 of the bracket 70 with the drive surface 102 of the drive plate 124 or by the compression springs 204 and 208.

As shown in FIGS. 2, 4, and 6 the compression springs 204–210 are disposed between a pair of integrally formed, spaced-apart, upright spring brackets 216, 218, each having a pair of integrally formed, inwardly bent rigid ears 220 for engaging the ends of the compression springs 204, 206, 208, 210. The compression springs are used to bias the guide blocks 140, 142, 164, 166 with which opposite ends of corresponding springs are in abutment. Thus when the electromagnet 72 is energized, the guide blocks 140, 142 compress the springs 208, 204, respectively, against ears 220. Likewise, when the armature 118 moves into the core 116, the guide blocks 164, 166 compress the springs 206, 210 against corresponding ears 220.

A subsequent energization of the coil 114 and the resultant actuation of the solenoid 72 moves the handle 40 from its ON position (FIGS. 5, 6) to its OFF position (FIGS. 2, 3 and 4). Specifically, the armature drive plate 152 is moved against the bias of the compression springs 206, 210 into contact with the armature drive plates' stops 188 to limit further movement of the armature drive plate 152 in the direction of the electromagnetic drive plate 120. This plate moves against the bias of the compression springs 204 and 208 to drive the bracket 70 in the handle 40 in the direction of the armature drive plate 152. The handle 40 then moved sufficiently along the opening 53 causing the toggle mechanism 48 to accelerate the handle 40 and the bracket 70 to the OFF position of the handle (FIGS. 2, 3 and 4).

The electrical coil 114 need only be energized by an electrical pulse for a length of time sufficient to move the handle 40 to a position at which the toggle mechanism 48 goes over-center. Subsequently, the mechanism moves the handle 40 and the bracket 70 to either the ON position or the OFF position of the handle.

The foregoing structure functions for opening and closing the circuit beaker contacts 44, 46 by remote control operation through the electromagnet 72. It does not enable manual operation of the circuit breaker when necessary, such as for maintenance or emergency purposes.

In accordance with this invention the manual operator 78, together with the interlock switch 80 and the switch button 82, function to permit opening and closing of the contacts on site. When necessary the manual operator 78 may be used for manually opening and closing the contacts. The manual operator 78 comprises (FIGS. 7, 8 and 10) the operating handle 108, a drive rod 222, a handle arm 224, and a handle 226. The operating handle 108 and the handle arm 224 are fixedly mounted on the drive rod 222. When the handle arm is rotated by grasping the handle 226, the manual operator 78 functions like a crank to move the bracket 70 and therefore the handle 40 between ON and OFF positions of the contacts 44, 46. For that purpose the drive rod 222 is pivotally mounted in spaced flanges 228, 230 of a bracket 216 (FIG. 8).

The opening 110 in the operating handle 108 is configured to conform with the projection 106 of the bracket 70 (FIGS. 7, 10), whereby clockwise and counter-clockwise rotation of the handle arm 224 is facilitated for ultimate movement of the handle 40 in either direction.

Figure 9:
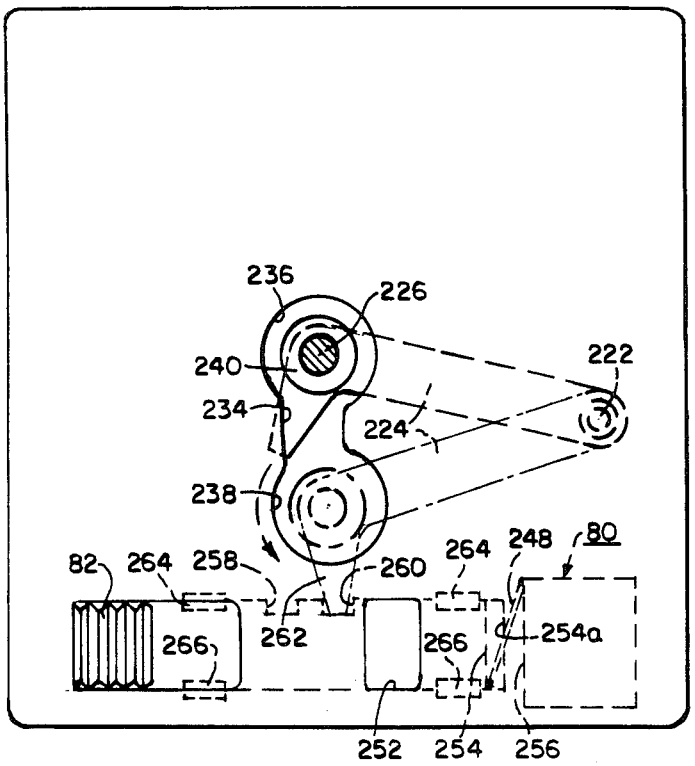
FIG. 9 is a plan view of the top of the device shown in FIG. 8.

The solenoid operator cover 84 for housing the solenoid operator 72 is secured by a plurality of screws 232 on the top cover 36 of the circuit breaker 30. In order to enable only authorized use of the circuit breaker 30 a handle lock or locking mechanism is provided so that the cover 84 serves as a rigid, tamper-resistant lock means whereby it is provided with a keyhole-shaped slot 234 (FIG. 9). The slot comprises enlarged upper and lower slot portions 236, 238 and an intermediate portion of reduced dimension, whereby the handle 226 is movable through the slot for opening and closing the contacts 44, 46.

Figure 8:
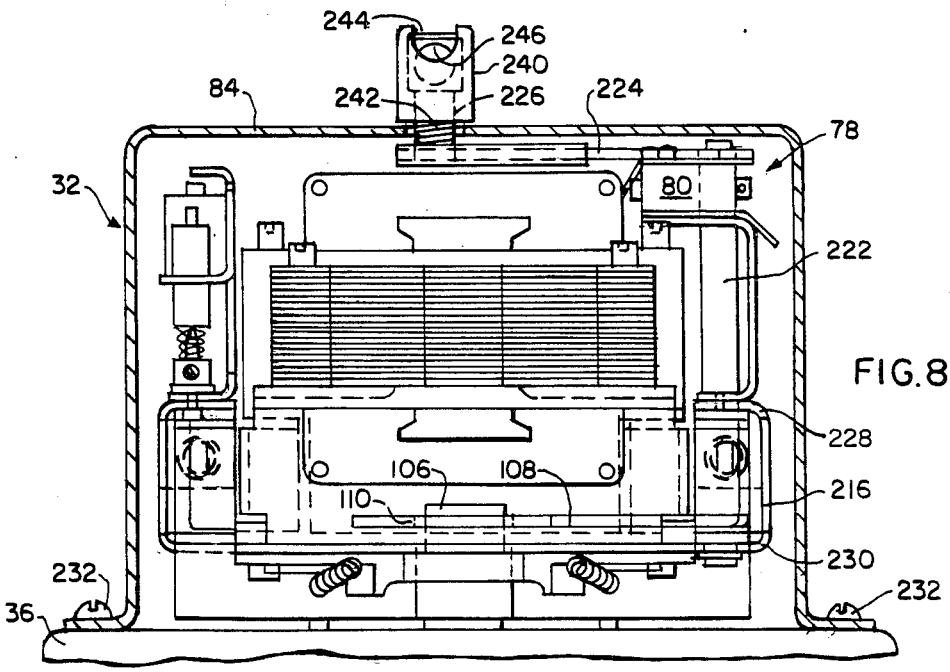
FIG. 8 is a vertical sectional view taken on the line VIII—VIII of FIG. 2.
Figure 10:
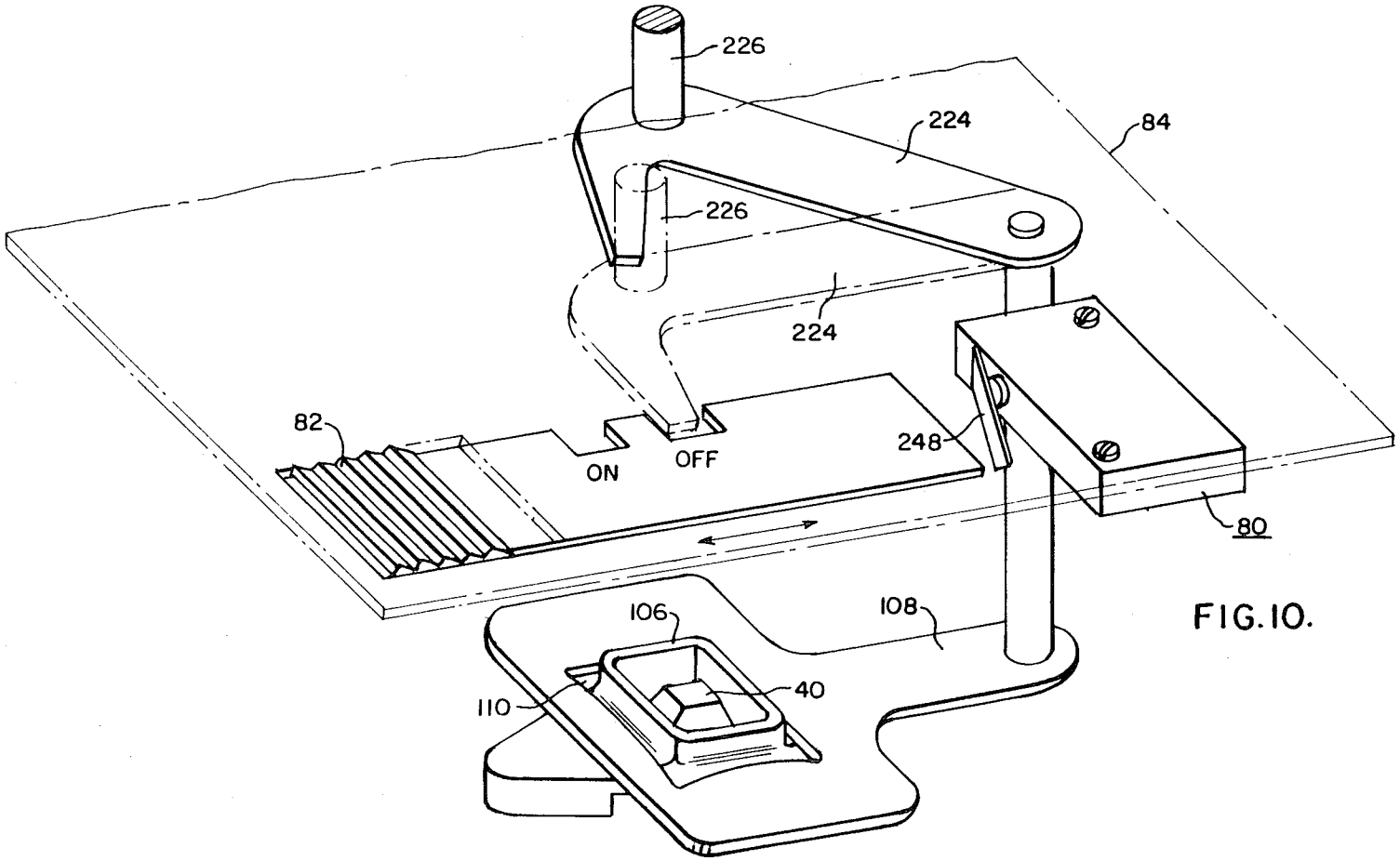
FIG. 10 is a pictorial view showing the interrelation between the manual arm, the handle of the circuit breaker, the switch button and the interlock switch.

A sleeve 240 is slidably mounted on the handle 226 and is biased upwardly by a coil spring 242 so that the lower end of the sleeve is retained above the cover 84 (FIG. 8). A pair of oppositely disposed and aligned U-shaped slots 244 (one of which is shown) are provided in the upper portion of the sleeve. When the sleeve 240 is lowered against the coil spring 242 into one of the enlarged slot portions 236, 238, the slots 244 are aligned with a hole 246 in the upper end of the handle 226 to enable the insertion of a lock, thereby preventing surreptitious movement of the handle from either the ON or OFF positions. Generally, this structure is disclosed in U.S. Pat. No. 4,554,421.

The interlock switch 80 is connected in series between the lined current and the coil 114 of the electromagnet 116 for opening and closing the circuit to the electromagnet. The switch 80 is preferably a microswitch having a normally OFF contact and having a switch arm 248 by which the switch is actuated. The switch button 82 is slidably mounted adjacent to the inner surface of the cover 84 for movement toward and away from the switch arm 248. A pair of openings 250, 252 (FIG. 9) in the cover are provided, the former opening for enabling manual access to the ribbed surface of the switch button and the latter opening for indicating ON and OFF positions of the button with respect to the switch 80. In the retracted or OFF position the right end 254 (FIG. 9) of the switch button 82 is retracted from the switch arm 248, whereby the switch 80 is in the normally OFF position. When the switch button 82 is advanced, the right end is in the position 254*a*, whereby the switch arm 248 is pressed against a trigger 256 to close the circuit through the switch 80.

In addition, the switch button 82 is provided with a pair of notches 258, 260. When the handle arm 224 is in the OFF position (FIG. 9) a projection 262 of the arm is seated within one of the notches 258, 260 depending upon whether the switch button 82 is in the ON or OFF position with respect to the interlock switch 80. The handle arm 224 in normal operation rotates to turn the circuit breaker between ON and OFF as required. The slot relief or notches 258, 260 in the switch button 82 allows free arm movement, while allowing the interlock switch 80 to remain closed thereby providing a current path to the coil 114. On the other hand, if it is preferred to insure that no coil current can flow, particularly when the circuit breaker is OFF, the switch button 82 is moved to the left, and the arm 224 is in the OFF position and locked in place if desired. When a projection 262 of the handle arm 224 is located in the notch 260, the coil circuit is OPEN and the contacts are OPEN. However, when the projection 262 is in the notch 258, the circuit through the coil is closed and the contacts 40, 46 are OPEN. When the handle arm 224 is in the ON position (FIG. 9), the contacts 44, 46 are closed. But the circuit through the coil 114 is opened or closed depending upon the position of the switch button 82.

The switch button 82 is assembled to and maintained in the cover 84 by means of oppositely facing molded tabs 264, 266 for holding the slide button 82 tightly against the inner surface of the cover 84 and in alignment with the openings 250, 252. Manifestly, when the cover is removed the switch button 82 is likewise removed, thereby opening the interlock switch 80 and therefore the circuit through the coil 114. Notwithstanding the inoperativeness of the coil 114, removal of the cover 84 does not prevent operation of the manual operator 78 for opening and closing the contacts 44, 46.

In conclusion, the device of this invention provides a mechanism for allowing personnel the choice of electrically disconnecting the coil of the operating mechanism when in the locked or OFF position.

What is claimed is:

1. An electrical circuit breaker comprising:

a pair of separable electrical contacts;

operating means for moving the contacts between OPEN and CLOSED positions;

a bracket engaging the operating means for movement between said positions;

solenoid actuated means for moving the bracket between ON and OFF positions corresponding to the CLOSED and OPEN positions of the contacts, the solenoid actuated means including an electromagnet and an armature separately movable against the bracket for alternately moving the operating means into one of the ON and OFF positions upon successive actuations of the solenoid actuated means;

a bistable mechanical latch having first and second positions for alternately placing the bracket in the ON or OFF position upon successive actuations of the electromagnet;

a manual operator for moving the bracket between the ON and OFF positions;

the bracket being immovable by the electromagnet from the OPEN contact position when the manual operator is in the OFF position;

the bracket being movable by the electromagnet between ON and OFF positions when the manual operator is in the ON position; and the latch including stop means movable into and out of the path of movement of the bracket for preventing movement of the solenoid actuated means when the manual operator is in the OFF position.

2. The device of claim 1 in which an interlock switch is serially connected to the electromagnet for opening and closing the circuit to the electromagnet.

3. The device of claim 2 in which a cover is disposed on the assembly of the solenoid actuated means and the interlock switch, a switch button for the interlock switch mounted on the cover and being manually movable to open and close the switch, and in an open circuit condition when the cover is removed.

4. The device of claim 3 in which the interlock switch is in the open circuit condition when the cover is removed.

5. The device of claim 4 in which a first movable plate is fixedly mounted on the electromagnet and a second movable plate is fixedly mounted on the armature, and the first and second plates being separately movable for guiding movement of the electromagnet and armature.

6. The device of claim 5 in which the mechanical latch is movable between first and second positions for limiting movement of the first plate in the first position and for limiting movement of the second plate in the second position.

7. The device of claim 6 in which the mechanical latch comprises abutment surfaces longitudinally spaced on the latch for alternate movement into and out of the paths of movement of the drive plates in response to movement of the bracket.

8. The device of claim 7 in which the manual operator comprises an arm movable between the ON and OFF positions of the manual operator.

9. The device of claim 8 in which the arm includes a portion extending through an opening in the cover.

10. The device of claim 9 in which the arm and cover comprise separable interfitting means for locking the arm in the ON or OFF position.

11. The device of claim 10 in which the switch button includes spaced notches corresponding to OPEN and CLOSED positions of the interlock switch, and the arm having an arm portion disposed in one of the notches when the arm is in the OFF position.

12. An electrical circuit breaker comprising:

a pair of separable electrical contacts movable between OPEN and CLOSED positions;

operating means including a handle for moving the contacts between said positions;

control means for actuating the operating means including an electromagnet having a coil and an armature separately connected to the handle for successively moving the handle between OFF and ON positions corresponding to OPEN and CLOSED positions of the contacts;

the control means also including an interlock switch serially connected to the coil for opening and closing the circuit to the coil;

a manual operator for moving the handle;

a cover for the control means and comprising a switch manual button for opening and closing the interlock switch; and the control means also including stop means operable by the manual operator into and out of the paths of movement of the armature for preventing movement when the operator is in the OFF position, whereby remote control operation of the circuit breaker is susceptible to an overriding manual control when necessary.

13. The device of claim 12 in which the switch button is slidably mounted on the cover for operating the switch between OPEN and CLOSED positions.

* * * * *